US005477439A

United States Patent [19]

Kowalenko et al.

[11] Patent Number: 5,477,439

[45] Date of Patent: Dec. 19, 1995

[54] FLUORESCENT LIGHTING SYSTEM

[75] Inventors: Alexander Kowalenko, Barrington; Marvin Feig, Northbrook, both of Ill.

[73] Assignee: Good Earth Lighting, Inc., Northbrook, Ill.

[21] Appl. No.: 234,084

[22] Filed: Apr. 28, 1994

[51] Int. Cl.[6] ..... F21V 21/00

[52] U.S. Cl. ..... 362/260; 362/147

[58] Field of Search ..... 362/221, 260, 362/147, 150, 404, 364, 365; 220/3.2; 248/27.1, 223.4, 224.4, 906; 174/52.1, 61; 361/674

[56] References Cited

U.S. PATENT DOCUMENTS

| | | | |
|---|---|---|---|
| 2,740,905 | 4/1956 | Henderson | 307/156 |
| 3,235,771 | 2/1966 | Schwartz | 315/276 |
| 3,243,659 | 3/1966 | Bostonian | 361/674 |
| 3,428,737 | 2/1969 | Pou | 174/52.1 |
| 3,646,401 | 2/1972 | Freegard et al. | 317/100 |
| 3,751,574 | 8/1973 | Fisher | 174/52 R |
| 4,156,272 | 5/1979 | Wandler | 362/365 |
| 4,336,575 | 6/1982 | Gilman | 362/364 |
| 4,674,015 | 6/1987 | Smith | 362/260 |
| 4,947,297 | 8/1990 | Druffel et al. | 362/364 |

*Primary Examiner*—Ira S. Lazarus
*Assistant Examiner*—Sara Sachie Raab
*Attorney, Agent, or Firm*—Seidel Gonda Lavorgna & Monaco

[57] ABSTRACT

A fluorescent lighting system including an electrical junction box, a lighting fixture having a receptacle for receiving a fluorescent lamp, and a fluorescent lamp ballast mounted inside the electrical junction box and connected between a source of electricity and the receptacle in the lighting fixture.

17 Claims, 3 Drawing Sheets

FLUORESCENT LIGHTING SYSTEM

FIELD OF THE INVENTION

The present invention relates to electrical fixtures, and in particular to fluorescent lighting fixtures which require a ballast for proper operation.

BACKGROUND OF THE INVENTION

Fluorescent lighting fixtures are well-known, and offer several advantages over other types of lighting fixtures such as incandescent lighting fixtures. Fluorescent lamps are more efficient, have a longer life, and run much cooler than incandescent lamps. These advantages make fluorescent lamps very attractive in many situations, particularly where it is desired to save energy without sacrificing light output.

The fluorescent lamp is a low-pressure gas discharge source in which light is produced predominantly by fluorescent powders activated by ultraviolet energy generated by a mercury arc. The lamp contains mercury vapor at low pressure with a small amount of inert gas for starting. The inner walls of the lamp are coated with fluorescent powders commonly called phosphors. When the proper voltage is applied to the lamp, an arc is produced by current flowing between the lamp electrodes through the mercury vapor. This discharge generates some visible light, but mostly invisible ultraviolet radiation. The ultraviolet radiation excites the phosphors to emit visible light.

Like most gas discharge lamps, fluorescent lamps must be operated in series with a current limiting device commonly called a ballast. The ballast limits the current to the value for which each lamp is designed, and also provides the required starting and operating lamp voltages. Fluorescent lamp ballasts typically comprise a transformer having a laminated core and coils, and a capacitor closely associated with the transformer to provide power factor correction. In order to protect the transformer and associated capacitor from physical damage, they are usually enclosed in a housing. Wires extend from the housing to enable the ballast to be connected between the power mains and the fluorescent lamp.

In the past, the ballast was mounted closely adjacent the lamp. In may cases, where there is adequate room (such as for overhead lighting fixtures in buildings) this is not a problem. However, in recent years there has been a surge in the popularity of fluorescent lamps which can be readily substituted for incandescent lamps, such as in table lamps, wall-mounted fixtures, and the like. In those cases, it is desired that the fluorescent bulb be as small as possible, preferably about the same size as the incandescent bulb it is intended to replace. It is also desirable that the fluorescent lamp be readily substitutable for the incandescent lamp. This has led to the development of fluorescent lamps which include the ballast as part of the lamp assembly. It has also led to a great deal of interest in adapting fixtures for incandescent lamps to fluorescent lamps.

One drawback of this type of fluorescent lamp assembly is that it is not suitable for use in problem environments, such as outdoors or even indoors in locations of high humidity. To enable such lamp assemblies to be used in problem environments, either the lamp must be sealed against the environment or the fixture in which it is used must be so sealed. This would require enormous retooling expense to adapt existing lamp assemblies and existing fixtures to make them suitable for use with fluorescent lamps in problem environments.

The present invention solves this problem by locating the ballast inside a standard electrical box, which enables fluorescent lamps to be readily used in conventional fixtures in problem environments without the need for sealing either the lamp assembly or the fixture in which it is used. This permits standard fluorescent lamps and standard lighting fixtures to be used in problem environments without having to modify the fixture except to provide it with a socket appropriate for the fluorescent lamp. Thus, major retooling expense is avoided, and the resulting fixture retains the appearance of a conventional incandescent lighting fixture.

SUMMARY OF THE INVENTION

In one of its aspects, the present invention is a fluorescent lighting system comprising an electrical junction box, a lighting fixture having a receptacle for receiving a fluorescent lamp, and a fluorescent lamp ballast mounted inside the electrical junction box and connected between a source of electricity and the receptacle in the lighting fixture.

In another aspect, the invention comprises the combination of a lighting fixture having a receptacle for receiving a fluorescent lamp and a fluorescent ballast for connecting the receptacle to a source of electricity. The ballast includes a mounting member for engaging a mating mounting member located inside a standard electrical junction box for removably mounting the ballast inside the junction box.

In a third aspect, the invention comprises the combination of an electrical junction box including a mounting member having a ballast engaging member and a fluorescent lamp ballast having a mating member for engaging the ballast engaging member on the mounting member and supporting the ballast inside the junction box.

DESCRIPTION OF THE DRAWINGS

For the purpose of illustrating the invention, there is shown in the drawings a form which is presently preferred; it being understood, however, that this invention is not limited to the precise arrangements and instrumentalities shown.

DESCRIPTION OF THE INVENTION

Figure 1:
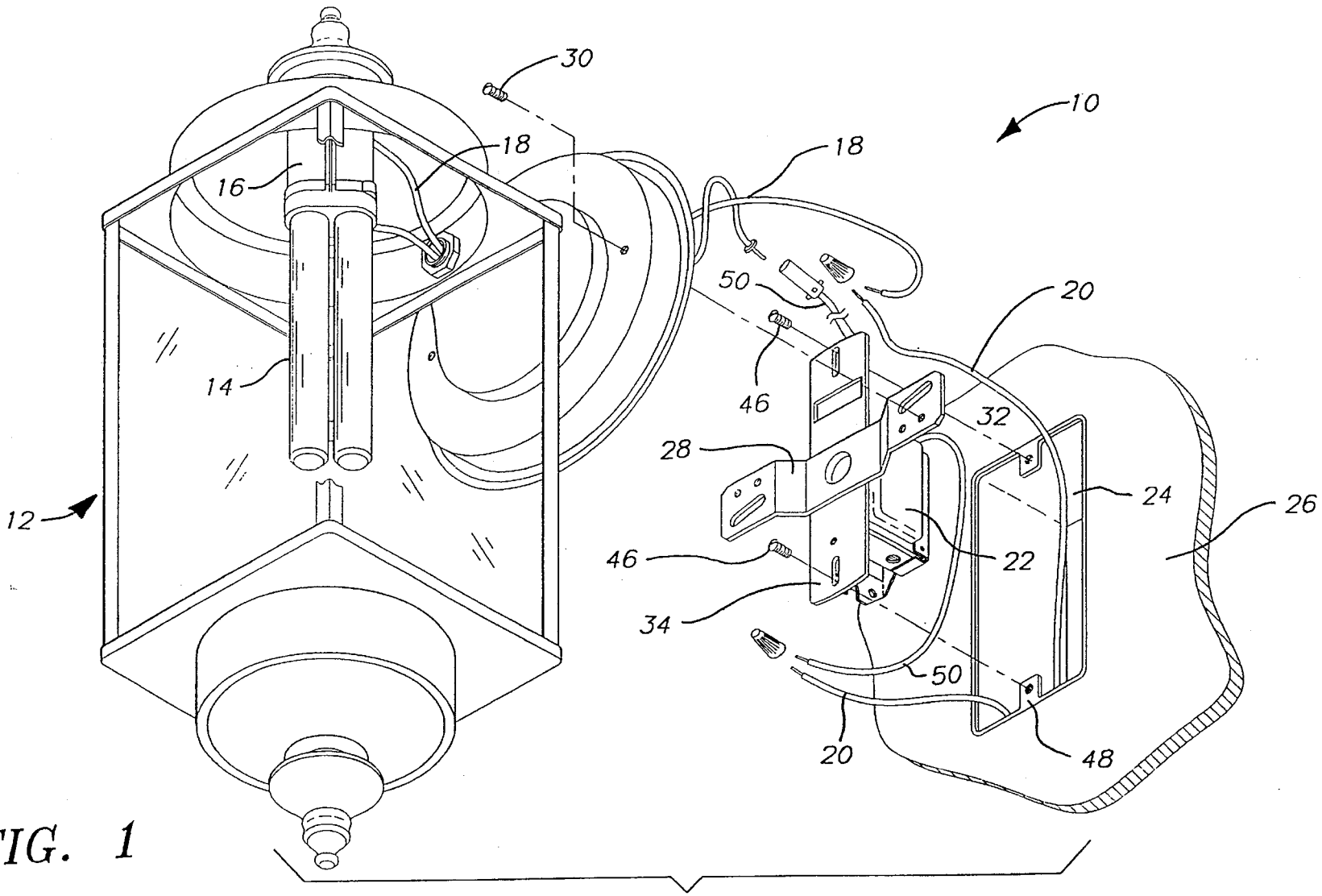
FIG. 1 is an exploded view of a lighting system according to the present invention.

Referring to the drawings, wherein like numerals indicate like elements, there is shown in FIG. 1 a lighting system 10 in accordance with the present invention. System 10 comprises a lighting fixture 12 which includes a fluorescent lamp 14 and a receptacle 16 for lamp 14. Lamp 14 may, for example, be a low-wattage PL-S lamp, as just one example of a suitable lamp. Receptacle 16 is, of course, chosen to be complementary to the desired lamp. In this example, where a PL-S lamp is used, receptacle 16 would be a type G23.

Fixture 12 also includes a pair of wires 18 which extend from fixture 16 for connecting receptacle 16 to a source of electricity such as wires 20. System 10 further comprises a fluorescent lamp ballast 22, through which receptacle 16 is connected to the source of electricity 20 and which provides the required starting and operating voltage to lamp 14.

Ballast 22 is mounted inside a standard electrical junction box 24, which is typically located in a wall, ceiling or other support. For simplicity, the invention will be described with junction box being mounted in a wall 26, but it should be understood that the invention is not limited to any specific configuration.

System 10 includes a generally conventional mounting strap 28 to which fixture 12 is mounted, such as by screws 30 which are received in correspondingly threaded openings 32 in mounting strap 28.

One, but by no means the only, unique feature of the invention is that fixture 12 may have any desired configuration. More importantly, fixture 12 may be any conventional incandescent fixture modified only to include a receptacle for a fluorescent lamp. It is not necessary to modify the fixture to receive the lamp ballast, since the ballast is located inside the junction box 24 as will be described in greater detail below. This leads to a number of advantages, including minimizing retooling costs to adapt incandescent fixtures to fluorescent lamps, maintaining a low fixture profile, eliminating the need to seal the fixture in the event it is desired to use the fixture in a problem environment such as outdoors, and eliminating exposure of the ballast to the ambient environment, thereby reducing shock hazards.

Figure 2:
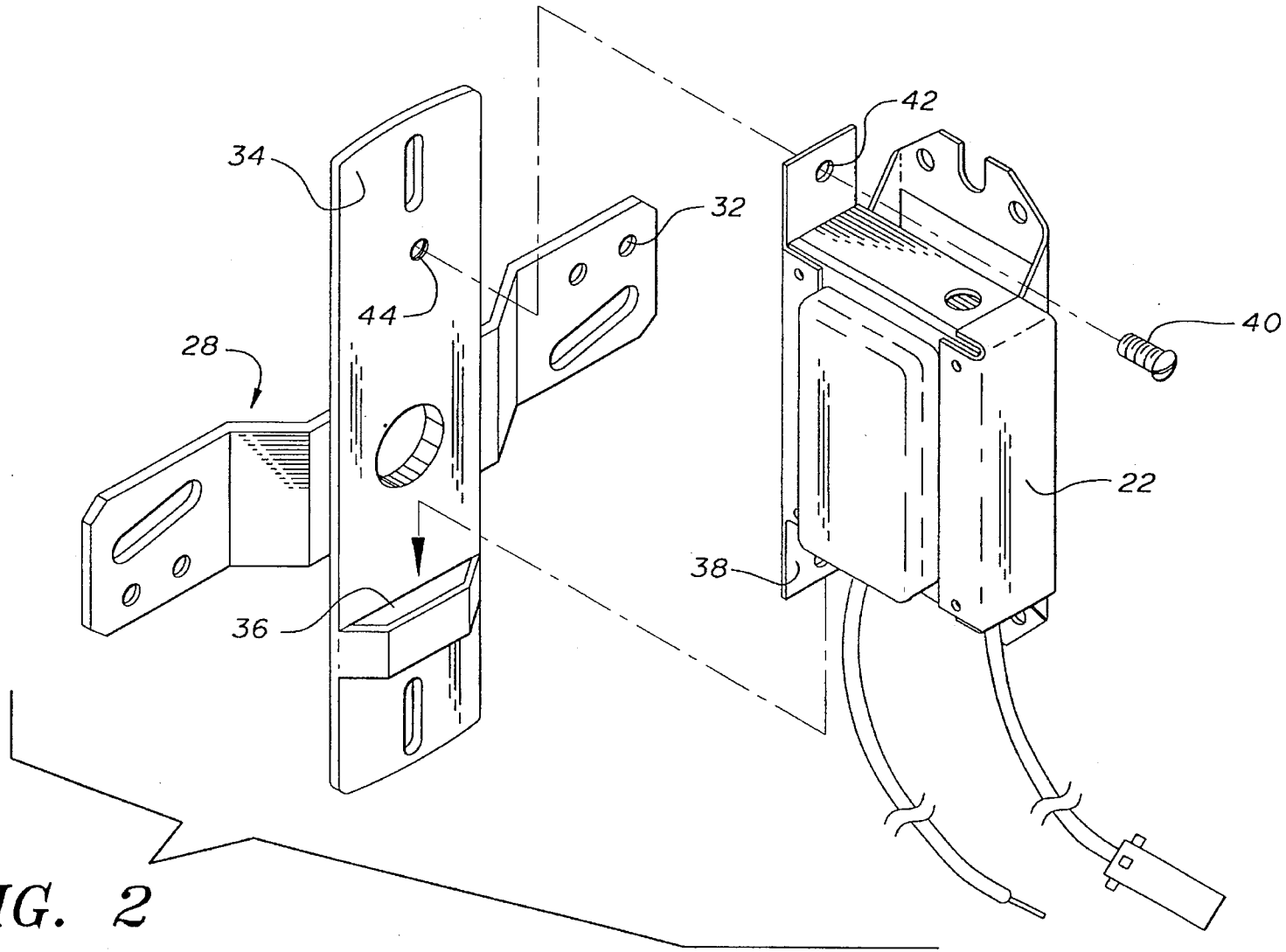
FIG. 2 is an exploded view of a fluorescent lamp ballast and junction box mounting member according to the present invention.

Referring particularly to FIG. 2, mounting strap 28 has attached to it a ballast strap 34. Ballast strap 34 includes a ballast engaging member in the form of a slot 36. Slot 36 may be formed, for example, by striking out a portion of ballast strap 34 in known manner, or may be formed by any other desired fabrication method without departing from the scope of the invention. Ballast 22 includes a mating member for engaging slot 36. The mating member is shown in FIG. 2 as a tongue 38 which is attached to one side of ballast 22. Tongue 38 slides into slot 36, to support ballast 22. Preferably, ballast 22 is removably secured to ballast strap by fasteners such as screws 40 which pass through openings 42 in tongue 38 and are screwed into threaded openings 44 in ballast strap 34. Of course, if desired, ballast 22 can be attached to ballast strap 34 in a more permanent fashion, such as by riveting.

Figure 3:
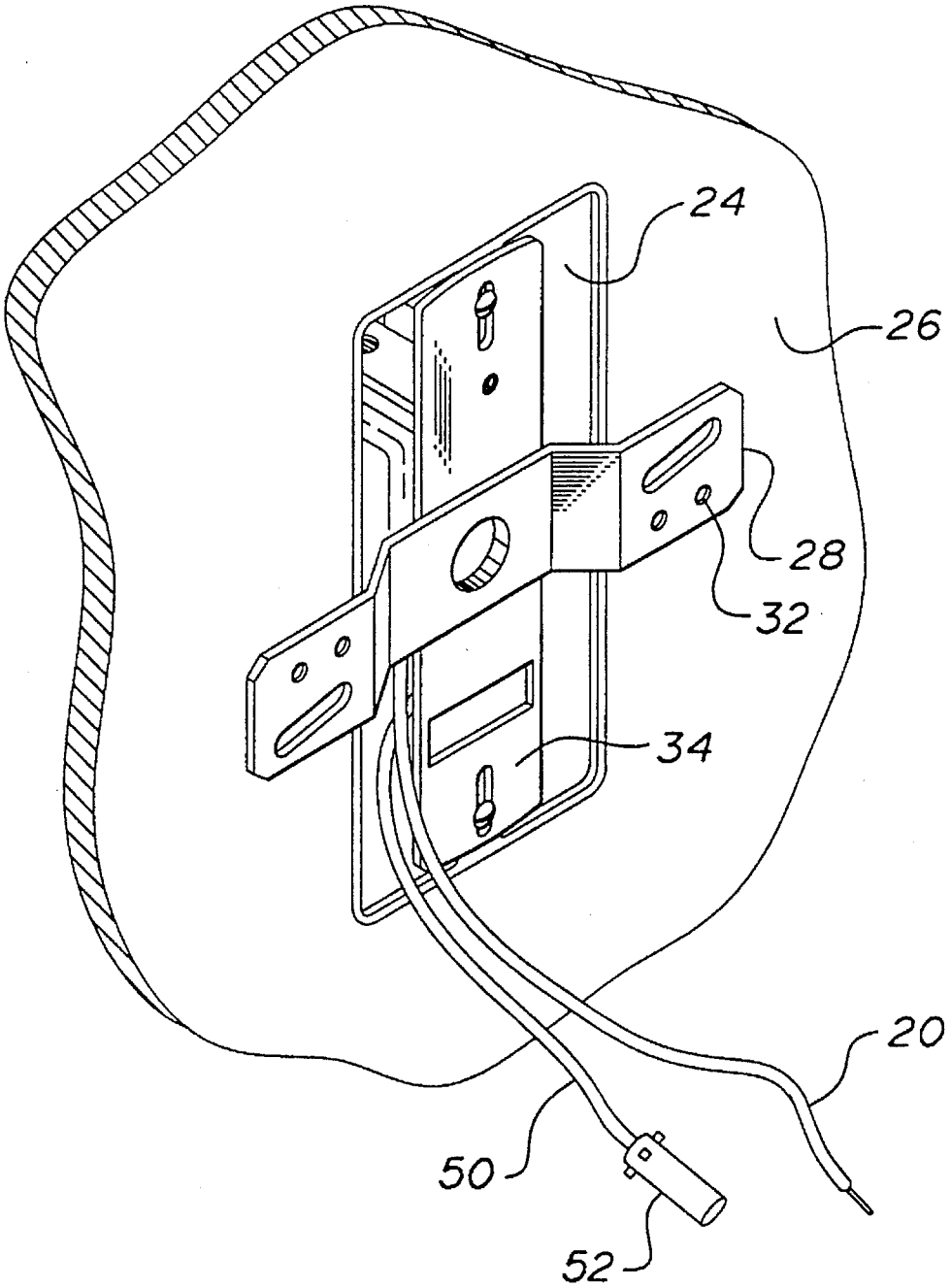
FIG. 3 illustrates the mounting of the ballast within a junction box using mounting members according to the present invention.

Referring now to FIG. 3, it can be seen that ballast strap 34 supports ballast 22 inside junction box 24. Ballast 22 is inserted into junction box 24 and ballast strap 34 is secured to junction box 24 by means of fasteners such as screws 46 which are screwed into threaded openings 48 conventionally provided in junction box 24.

To connect fixture 12 to source wires 20, it is only necessary to connect ballast 22 between wires 20 and fixture 12. Ballast 22 is provided with wires 50 for this purpose. All that is necessary is to connect one of the source wires 20 to one of the ballast wires 50 and one of the fixture wires 18 to the other ballast wire. The remaining fixture wire and the remaining source wire are then connected together, completing the circuit. If desired, U.L.-approved connectors such as connector 52 may be used to simplify and speed up the connections.

It will be appreciated that the present invention provides a simple and inexpensive way of mounting a ballast inside a standard electrical junction box. For problem environments, such as outdoors, the junction box will typically be sealed against the environment. By locating the ballast inside a sealed junction box, it becomes unnecessary to seal the light fixture or to use a sealed ballast, both of which would add considerably to the cost and would offset the savings potential of converting to a fluorescent lamp in the first instance. Thus, the present invention makes it highly cost-effective to convert conventional incandescent fixtures to fluorescent fixtures, and makes it highly cost-effective to design new fluorescent fixtures without the need for sealed ballasts and sealed housings.

The present invention may be embodied in other specific forms without departing from the spirit or essential attributes thereof and, accordingly, reference should be made to the appended claims, rather than to the foregoing specification, as indicating the scope of the invention.

We claim:

1. A fluorescent lighting system comprising:

an electrical junction box attached to a supporting structure;

a lighting fixture having a receptacle for receiving a fluorescent lamp; and a fluorescent lamp ballast mounted inside the electrical junction box, having a first electrical connection to a source of electricity and a second electrical connection to the receptacle of the lighting fixture, the ballast being supported and substantially surrounded by the junction box, the ballast including a mounting member for engaging a mating mounting member located inside the junction box for removably mounting the ballast inside the junction box.

2. A fluorescent lighting system as in claim 1, wherein the mounting member on the ballast comprises a tongue extending from the ballast for engaging the mating mounting member.

3. A fluorescent lighting system as in claim 2, wherein the mating mounting member comprises a strap sized to fit within the electrical junction box and attached to the junction box so as to position the ballast within the junction box and having a slot therein for receiving the tongue.

4. A fluorescent lighting system comprising:

an electrical junction box attached to a supporting structure;

a lighting fixture having a receptacle for receiving a fluorescent lamp; and a fluorescent lamp ballast mounted inside the electrical junction box, having a first electrical connection to a source of electricity and a second electrical connection to the receptacle of the lighting fixture, the ballast being supported and substantially surrounded by the junction box, the junction box including a mounting member having a ballast engaging member and the ballast having a ranting member for engaging the ballast engaging member on the mounting member and supporting the ballast inside the junction box.

5. A fluorescent lighting system, comprising:

a lighting fixture having a receptacle for receiving a fluorescent lamp;

a standard electrical junction box for mounting within and being supported by a structure and having a fluorescent lamp ballast engaging member attached thereto; and a fluorescent lamp ballast having a mating member for engaging the ballast engaging member of the standard junction box and supporting the ballast inside the standard junction box, the ballast being electrically connected to the lighting fixture.

6. A fluorescent lighting system, comprising:

a lighting fixture having a receptacle for receiving a fluorescent lamp;

an electrical junction box for mounting within and being supported by a structure and having a mounting member therein; and a fluorescent lamp ballast having a mounting member for nonpermanently engaging the mounting member in the junction box for removably mounting the ballast inside the junction box, the mounting member in the junction box being positioned external to the ballast.

7. In combination, a lighting fixture having a receptacle for receiving a fluorescent lamp and a fluorescent ballast for connecting the receptacle to a source of electricity, the ballast including a mounting member for engaging a mating mounting member located inside a standard electrical junction box for removably mounting the ballast inside the junction box, the ballast being electrically connected to both the lighting fixture and to an electrical source, and wherein the standard electrical junction box is mounted within a structure such as a wall and supports the ballast.

8. A combination as in claim 7, wherein the mounting member on the ballast comprises a tongue extending from the ballast for engaging the mating mounting member inside the junction box.

9. A combination as in claim 8, wherein the mating mounting member comprises a strap sized to fit within the junction box and attached to the junction box so as to position the ballast within the junction box and having a slot therein for receiving the tongue.

10. In combination, an electrical junction box including a mounting member having a ballast engaging member and a fluorescent lamp ballast having a mating member for engaging the ballast engaging member on the mounting member and supporting the ballast inside the junction box, the junction box being mounted within a supporting structure, and wherein the mounting member is positioned external to the ballast.

11. In combination, an electrical junction box and a fluorescent lamp ballast, the junction box including a mounting strap attached to the junction box and having a slot therein for nonpermanently receiving a projection on the ballast for removable mounting the ballast inside the junction box, the ballast being supported by the strap.

12. A fluorescent lighting system, comprising:

a lighting fixture having a receptacle for receiving a fluorescent lamp;

an electrical junction box for mounting within a supporting structure;

a mounting structure disposed between the lighting fixture and the electrical junction box, the mounting structure attaching the lighting fixture to the electrical junction box such that the electrical junction box supports the lighting fixture; and a fluorescent lamp ballast attached to and supported by the mounting structure so as to be positioned within the junction box.

13. A fluorescent lighting system as in claim 12, wherein the mounting structure includes a strap and wherein the fluorescent lamp ballast is attached to and supported by the strap.

14. A fluorescent lighting system as in claim 13, wherein the strap has a slot formed thereon which mates with a tongue formed on the fluorescent lamp ballast.

15. A fluorescent lighting system as in claim 12, wherein the mounting structure comprises first and second straps attached to one another, the first strap mounting to the electrical junction box and having a slot formed therein, the fluorescent lamp ballast having a tongue formed thereon which attaches to and is supported by the slot formed in the first strap, and wherein the lighting fixture is removably attached to and supported by the second strap.

16. A fluorescent lighting system as in claim 12, wherein the mounting structure comprises first and second straps attached to one another, the first strap mounting to the electrical junction box and attaching to and supporting the fluorescent lamp ballast, and wherein the lighting fixture is removably attached to and supported by the second strap.

17. A fluorescent lighting system for mounting to a structure having an electrical junction box mounted therein, wherein the lighting system comprises:

a strap member having first and second attachment points for attaching to the electrical junction box, and having a mounting member formed thereon for engaging with a mating mounting member of a fluorescent lamp ballast for supporting the same on one side of the strap so that when the strap is attached to the electrical junction box the ballast is positioned within the junction box; and a lighting fixture having a receptacle for receiving a fluorescent lamp, the lighting fixture being positioned on the opposite side of the strap from the ballast when the lighting fixture is mounted on the structure, the lighting fixture furthermore sealing the ballast within the electrical junction box when the lighting fixture is attached to the structure.

* * * * *